US005685530A

United States Patent [19]

DeLise

[11] Patent Number: 5,685,530

[45] Date of Patent: Nov. 11, 1997

[54] FOLDED BOOKLET AND METHOD FOR MAKING SAME

[76] Inventor: Stephen W. DeLise, 5 Captain's Walk, Bay Shore, N.Y. 11706

[21] Appl. No.: 644,520

[22] Filed: May 10, 1996

[51] Int. Cl.[6] ..... B41L 43/12; B42D 1/00

[52] U.S. Cl. ..... 270/37; 281/2; 281/3.1; 283/61; 283/62

[58] Field of Search ..... 270/37, 52.14, 270/52.18, 52.19; 281/2, 3.1, 5; 283/61, 62, 56, 63.1, 34, 35

[56] References Cited

U.S. PATENT DOCUMENTS

| | | | |
|---|---|---|---|
| 1,239,965 | 9/1917 | Reinhold . | |
| 1,326,859 | 12/1919 | Grammer . | |
| 2,751,222 | 6/1956 | Dexter . | |
| 3,760,520 | 9/1973 | Hamilton | 283/63.1 X |
| 3,773,314 | 11/1973 | Giovannini . | |
| 4,010,299 | 3/1977 | Hershey, Jr. et al. . | |
| 4,097,067 | 6/1978 | Schechter . | |
| 4,229,926 | 10/1980 | Rowling . | |
| 4,270,742 | 6/1981 | Kobayashi . | |
| 4,583,763 | 4/1986 | Shacklett, Jr. . | |
| 4,660,856 | 4/1987 | Shacklett, Jr. . | |
| 4,812,195 | 3/1989 | Vijuk . | |
| 4,817,931 | 4/1989 | Vijuk . | |
| 4,850,611 | 7/1989 | Skelton | 281/2 X |
| 4,887,373 | 12/1989 | Macaulay | 283/2 X |
| 4,997,205 | 3/1991 | Hansch | 281/2 |
| 5,458,374 | 10/1995 | Vijuk . | |

*Primary Examiner*—Hoang Nguyen
*Attorney, Agent, or Firm*—Collard & Roe, P.C.

[57] ABSTRACT

A method for folding printed sheets into a closed, secured outsert including the steps of binding two or more different printed sheets together to form a booklet having a bound edge and a spaced opposite free edge. A first fold is formed in the booklet, parallel to the free edge, to position the free edge between the first fold and the bound edge. One or more additional intermediate folds may also be provided. An adhesive is dispensed onto a section of the booklet and a final fold encloses the free edge and the adhesive to provide a closed, secured outsert. The folds divide the booklet into several panels of approximately equal width, which are substantially superimposed on top of each other. A closed, secured outsert is disclosed. The outsert includes a booklet made from two or more printed sheets which are provided into a number of panels which are then substantially superimposed onto each other.

17 Claims, 3 Drawing Sheets

FOLDED BOOKLET AND METHOD FOR MAKING SAME

BACKGROUND OF THE INVENTION

1. Field of the Invention

The present invention relates to a folded booklet and method for making same. More particularly, it relates to a booklet which is folded into a miniature, secured medical outsert.

2. The Prior Art

Medical outserts are made by folding a single printed sheet into miniature secured packets which are issued with pharmaceutical products. The outserts are packaged with the pharmaceutical product during the manufacturing and packaging process. Due to the high speed of the packaging process, the outsert must have all loose edges secured so that it can be reliably dispensed.

As the size of the printed sheet increases, numerous additional folds are required to provide the same size miniature outsert. The complexity of the folding operation increases significantly with the introduction of each new set of folds. An example of a multi-fold outsert is shown in U.S. Pat. No. 5,458,374. This patent discloses several embodiments of a multi-fold outsert, all of which include a combination of parallel folds and cross folds. Combining parallel folds and cross folds on a large printed sheet is a complex operation requiring parallel folding machines and separate cross folding machines. Accordingly, it would be desirable to convert even larger printed sheets into folded outserts by using parallel folds only.

SUMMARY OF THE INVENTION

It is therefore an object of the present invention to overcome the drawbacks of the prior art and to provide a secured outsert which can be readily formed from a printed booklet.

It is a further object of the present invention to provide a secured outsert with additional printed information, formed with parallel folds only.

These and other related objects are achieved according to the invention by a method for folding two different printed sheets into a closed, secured outsert, including the following steps. Two different printed sheets are bound or interleaved together to form a booklet having a bound or closed edge and a spaced opposite free edge. A first fold is formed in the booklet, parallel to the free edge, to position the free edge between the first fold and the bound or closed edge. An adhesive is then dispensed onto a section of the booklet and a second fold is formed in the booklet, parallel to the first fold, to position the first fold adjacent the bound or closed edge to enclose the free edge and the adhesive to provide a closed, secured outsert. The second fold is adjacent the free edge and the dispensed adhesive contacts a section of the booklet which is adjacent the bound or closed edge.

In an alternate method, the two different printed sheets are bound or interleaved together to form a booklet having a bound edge and a spaced opposite free edge. A first fold is formed in the booklet, parallel to the free edge, to position the free edge between the first fold and the bound edge. A second fold is formed in the booklet parallel to the first fold. An adhesive is then dispensed onto a section of the booklet A third fold is formed in the booklet, parallel to the second fold, to position the second fold adjacent the bound edge to enclose the free edge and the adhesive to provide a closed, secured outsert. The second fold is approximately centrally located between the free edge and the first fold to position the first fold adjacent the free edge. The third fold is adjacent the free edge. The folds divide the booklet into a plurality of panels of approximately equal width which are substantially superimposed on top of each other.

A further embodiment discloses a method for folding two different printed sheets into a closed, secured outsert including the following steps. The two different sheets are bound or interleaved together to form a booklet having a bound edge and a spaced opposite free edge. A first fold is formed in the booklet, parallel to the free edge, to position the free edge between the first fold and the bound edge. A second fold is formed in the booklet, parallel to the first fold and adjacent the free edge to enclose the free edge. An adhesive is then dispensed onto a section of the booklet and a final fold is formed in the booklet, parallel to the second fold, to enclose the adhesive and provide a closed, secured outsert. The dispensed adhesive contacts a section of the booklet adjacent the bound edge. At least one additional intermediate fold is formed, parallel to the second fold prior to the step of dispensing an adhesive. The folds divide the booklet into a plurality of panels of approximately equal width which are substantially superimposed on top of each other.

A closed, secured outsert is also disclosed which includes a booklet comprising two different printed sheets bound or interleaved together to form a bound edge and a free edge. A plurality of fold lines are formed in the booklet parallel to each other and the free edge. Adhesive means are disposed on the booklet to form the closed, secured outsert with the free edge enclosed therein. The fold lines divide the booklet into a plurality of panels including a first panel adjacent the bound edge, and wherein the adhesive means contacts the first panel.

The plurality of panels includes a second panel adjacent the free edge, and at least one additional panel between the first panel and the second panel. The panels are approximately the same width as each other with the fold lines substantially superimposing all of the panels on top of each other. The plurality of panels include a second panel adjacent the free edge and a third panel located between the first panel and the second panel. The second and third panels have approximately the same width as each other, and the first panel has a width approximately one-half the width of the second and third panels. The first fold line superimposes the second panel onto the third panel. The second fold line folds the superimposed second and third panels in half. The third fold line superimposes the first panel onto the folded second and third panels.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
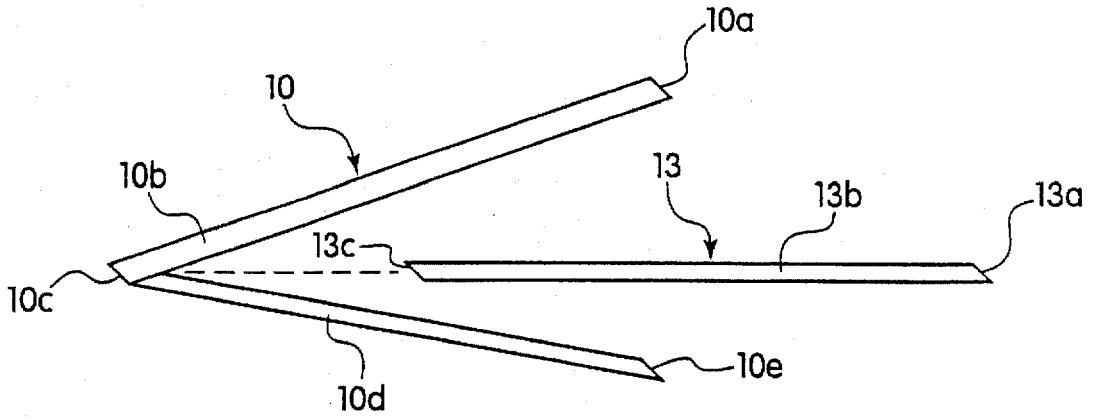
FIG. 1 is a perspective view of two different printed sheets forming a booklet according to the invention.
Figure 2:
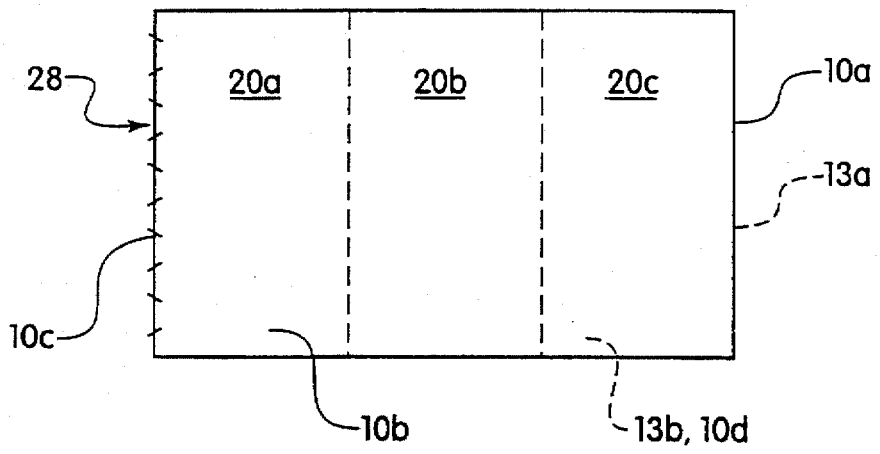
FIG. 2 is a top plan view of the booklet.

Referring now in detail to the drawings and in particular, FIG. 1 there is shown a first folded printed sheet 10 having a free edge 10*a*, a top sheet 10*b*, a folded edge 10*c*, a bottom sheet 10*d*, and a further free edge 10*e*. A flat printed sheet 13 is also shown having free edge 13*a*, a sheet portion 13*b* and a further free edge 13*c*. Free edge 13*c* is bound to or interleaved with folded edge 10*c* in order to form a booklet which is shown in FIG. 2 with a bound edge 28. Such a booklet includes six pages, i.e. the two sides of top sheet 10*b*, the two sides of sheet portion 13*b* and the two sides of bottom sheet 10*d*. The booklet shown in FIG. 2 is divided into three panels 20*a*, 20*b* and 20*c*. If additional surface area is required for the printed text, the booklet may be enlarged in various ways. Printed sheets 10 and 13 can be made longer which would effectively provide additional panels to the right side of panel 20*c*. Additional sheets, similar to flat printed sheet 13, may be placed overlying sheet 13 and commonly bound with edges 10*c* and 13*c*. Additional printed sheets, similar to folded printed sheet 10 may also be added, which will be described in greater detail below.

Figure 4:
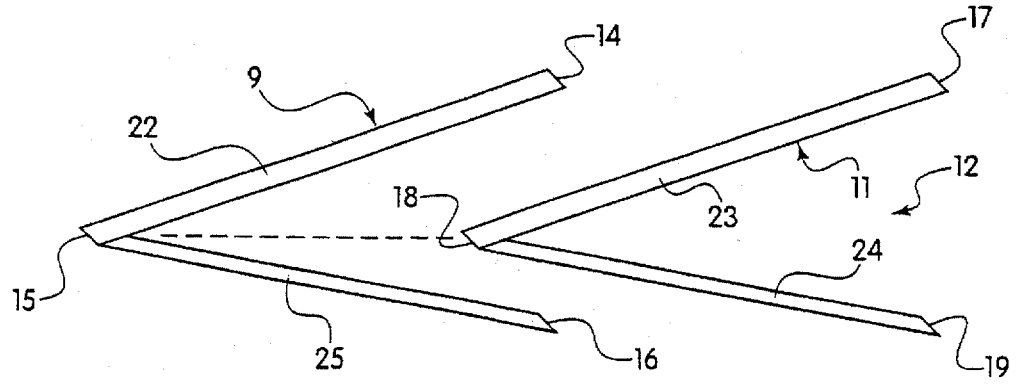
FIG. 4 is a perspective view of two different printed sheets forming an alternate booklet according to a further embodiment of the invention.
Figure 5:
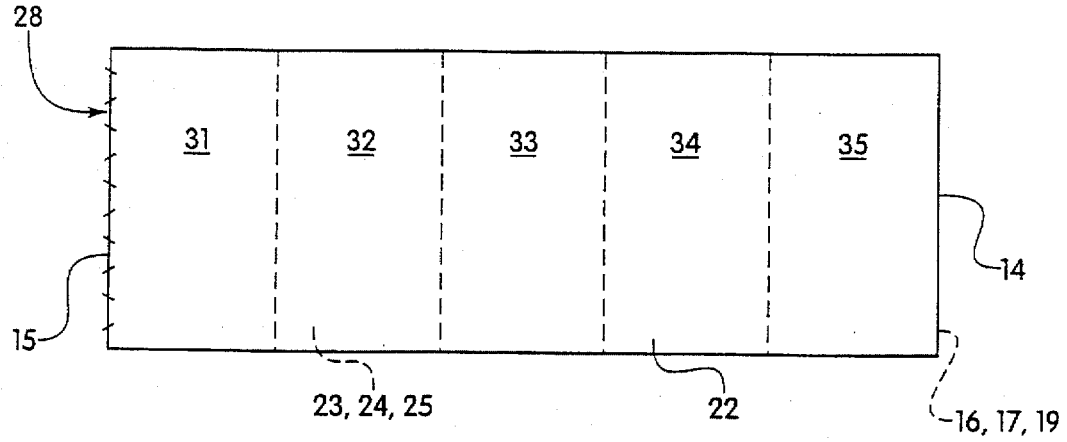
FIG. 5 is a top plan view of the booklet.

FIG. 4 shows an alternate embodiment of a booklet having a first folded printed sheet 9 and a second folded printed sheet 11. Folded printed sheet 9 includes a free edge 14, a folded edge 15, a further free edge 16, a top sheet 22, and a bottom sheet 25. A second folded printed sheet 11 includes a free edge 17, a folded edge 18, a second free edge 19, a top sheet 23, and a bottom sheet 24. Printed sheets 9 and 11 are nested together and optionally bound at folded edges 15 and 18 to form a bound end 28, which can be seen in FIG. 5. The resulting booklet has eight pages, i.e. the two pages of top sheet 22, the two pages of top sheet 23, the two pages of bottom sheet 24, and the two pages of bottom sheet 25. The booklet shown in FIG. 5 has been divided into five panels 31–35.

The booklets which are created with six or more pages are then parallel folded two or more times along lines which separate the panels. These dividing lines are generally parallel to each other and parallel to the bound edge and the free edges of the booklet. The series of folds made to the various booklets superimposes all the panels on top of each other with the free edges tucked inside.

Figure 3A:
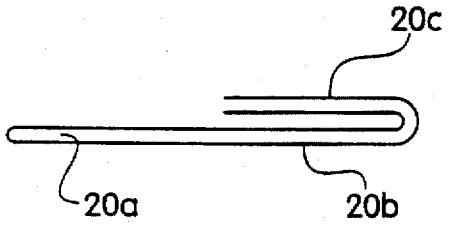
FIG. 3A is a front side elevational view of the booklet from FIG. 2 with a first parallel fold.
Figure 3B:
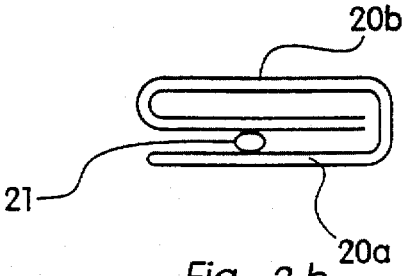
FIG. 3B is a front side elevation view of the booklet with a second parallel fold and an adhesive.
Figure 6A:
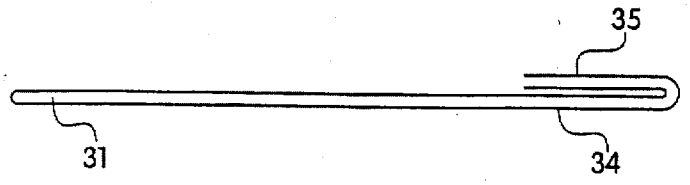
FIG. 6A is a front side elevational view of the booklet with a parallel fold.
Figure 6B:
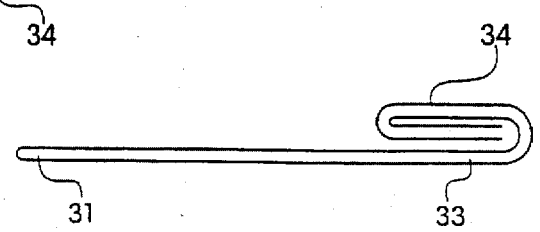
FIG. 6B is a front side elevational view of the booklet with a second parallel fold.
Figure 6C:
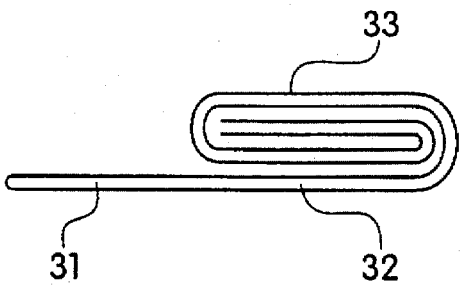
FIG. 6C is a front side elevational view of the booklet with a third parallel fold.
Figure 6D:
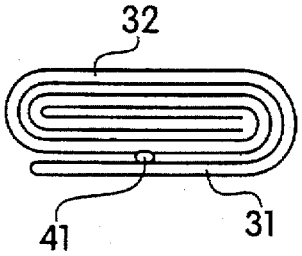
FIG. 6D is a front side elevational view with a fourth parallel fold and an adhesive.

The most basic folded booklet can be seen in FIGS. 3A and 3B which involves the booklet from FIG. 2 which has three panels. Panel 20*c* is folded in to overlie panel 20*b*. These combined panels are then folded to overlie panel 20*a* with the free edges tucked inside. An adhesive 21 holds the folded booklet together. This type of end-over-end fold may be achieved with a greater number of panels as well. For a booklet with four panels, three consecutive folds would be made beginning at the free edges. A five-panel embodiment is shown in FIGS. 6A–6D. Initially, the end panel 35 is folded to overlie panel 34. These combined panels are folded to overlie panel 33 and then panel 32. In FIG. 6D, the four overlying panels are folded over panel 31 and secured by an adhesive 41.

Figure 7A:
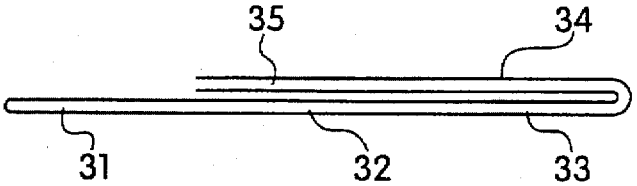
FIG. 7A is a front side elevational view of the booklet from FIG. 5 with an alternate parallel fold.
Figure 7B:
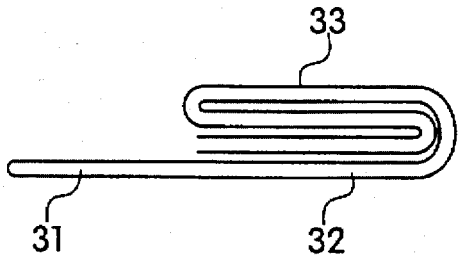
FIG. 7B is a front side elevational view of the booklet with a second parallel fold.
Figure 7C:
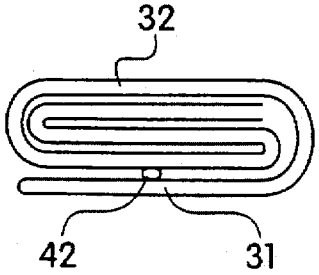
FIG. 7C is a front side elevation view of the booklet with a third parallel fold and an adhesive.

An alternate embodiment with the five-panel booklet is shown in FIGS. 7A–7C. Initially, panels 34 and 35 are folded to overlie panels 33 and 32, respectively. Combined panels 33 and 34 are then folded to overlie panels 35 and 32. In the last step, the four panels are folded onto panel 31 and secured by an adhesive 42.

While numerous other embodiments exist, the following basic principles apply to each embodiment. A booklet is formed with a bound end and a minimum of six pages. The booklet is divided into a minimum of three panels. The panels are folded until they substantially superimpose each other with the free end of the booklet tucked inside. While the various panels are generally the same size, they do vary in width slightly. In order to precisely align all of the folds, which define opposite outer edges of the outsert, the inner panels must be slightly smaller than the outer panels which wrap over the inner panels. It is also possible to provide a short leg, for example during the initial fold.

Any suitable binding method may be employed in fabricating the booklets, for example, gluing, stitching etc. In addition, a number of booklets may be bound simultaneously, folded simultaneously and secured simultaneously. The multiple booklet pack would then be cut into individual outserts.

Accordingly, while only several embodiments of the present invention have been shown and described, it is obvious that many changes and modifications may be made thereunto without departing from the spirit and scope of the invention.

What is claimed is:

1. A method for folding two different printed sheets into a closed, secured medical outsert comprising the steps of:

binding the two different printed sheets together to form a booklet having a bound edge and a spaced opposite free edge;

forming a first fold in the booklet, parallel to the free edge, to position the free edge between the first fold and the bound edge;

dispensing an adhesive onto a section of the booklet; and forming a final fold in the booklet, parallel to the first fold, to position the first fold adjacent the bound edge to enclose the free edge and the adhesive to provide a closed, secured medical outsert.

2. The method according to claim 1, wherein the final fold is adjacent the free edge and the dispensed adhesive contacts a section of the booklet which is adjacent the bound edge.

3. A method for folding two different printed sheets into a closed, secured medical outsert comprising the steps of:

binding the two different printed sheets together to form a booklet having a bound edge and a spaced opposite free edge;

forming a first fold in the booklet, parallel to the free edge, to position the free edge between the first fold and the bound edge;

forming a second fold in the booklet parallel to the first fold;

dispensing an adhesive onto a section of the booklet; and forming a third fold in the booklet, parallel to the second fold, to position the second fold adjacent the bound edge to enclose the free edge and the adhesive to provide a closed, secured medical outsert.

4. The method according to claim 3, wherein the second fold is approximately centrally located between the free edge and the first fold to position the first fold adjacent the free edge.

5. The method according to claim 4, wherein the third fold is adjacent the free edge.

6. The method according to claim 5, wherein said folds divide the booklet into a plurality of panels of approximately equal width which are substantially superimposed on top of each other.

7. A method for folding two different printed sheets into a closed, secured medical outsert comprising the steps of:

binding the two different sheets together to form a booklet having a bound edge and a spaced opposite free edge;

forming a first fold in said booklet, parallel to the free edge, to position the free edge between the first fold and the bound edge;

forming a second fold in the booklet, parallel to the first fold and adjacent the free edge to enclose the free edge;

dispensing an adhesive onto a section of the booklet; and forming a final fold in said booklet, parallel to said second fold, to enclose the adhesive and provide a closed, secured medical outsert.

8. The method according to claim 7, wherein the dispensed adhesive contacts a section of the booklet adjacent the bound edge.

9. The method according to claim 8, further comprising:

forming at least one additional intermediate fold, parallel to said second fold prior to said step of dispensing an adhesive.

10. The method according to claim 9, wherein said folds, divide the booklet into a plurality of panels of approximately equal width which are substantially superimposed on top of each other.

11. A closed, secured medical outsert including two different printed sheets comprising:

a booklet comprising the two different printed sheets bound together to form a bound edge and a free edge;

a plurality of fold lines formed in the booklet parallel to each other and the free edge; and adhesive means disposed on the booklet to form the closed, secured medical outsert with said free edge enclosed therein.

12. The booklet according to claim 11, wherein said fold lines divide the booklet into a plurality of panels including a first panel adjacent the bound edge, and wherein said adhesive means contacts said first panel.

13. The booklet according to claim 12, wherein said plurality of panels includes a second panel adjacent the free edge, and at least one additional panel between said first panel and said second panel wherein said panels are approximately the same width as each other with said fold lines substantially superimposing all of said panels on top of each other.

14. The booklet according to claim 12, wherein said plurality of panels includes a second panel adjacent the free edge and a third panel located between said first panel and said second panel, said second and third panels have approximately the same width as each other, and said first panel has a width approximately one-half the width of said second and third panels.

15. The booklet according to claim 14, wherein said plurality of fold lines comprise:

a first fold line superimposing said second panel onto said third panel;

a second fold line folding said superimposed second and third panels in half; and a third fold line superimposing said first panel onto said folded second and third panels.

16. A method for folding two different printed sheets into a closed, secured medical outsert comprising the steps of:

interleaving the two different printed sheets together to form a booklet having a closed edge and a spaced opposite free edge;

forming a first fold in the booklet, parallel to the free edge, to position the free edge between the first fold and the closed edge;

dispensing an adhesive onto a section of the booklet; and forming a final fold in the booklet, parallel to the first fold, to position the first fold adjacent the closed edge to enclose the free edge and the adhesive to provide a closed, secured medical outsert.

17. A closed, secured medical outsert including two different printed sheets comprising:

a booklet comprising the two different printed sheets interleaved together to form a closed edge and a free edge;

a plurality of fold lines formed in the booklet parallel to each other and the free edge; and adhesive means disposed on the booklet to form the closed, secured medical outsert with said free edge enclosed therein.

* * * * *